US006102352A

United States Patent [19]

Kvalvog

[11] Patent Number: 6,102,352

[45] Date of Patent: Aug. 15, 2000

[54] CLING RESISTANT DRINK COASTER

[76] Inventor: Douglas Kvalvog, Coastal Coasters, 835 W. Price Rd., Warehouse #1, Brownsville, Tex. 78520

[21] Appl. No.: 09/263,708

[22] Filed: Mar. 5, 1999

[51] Int. Cl.[7] ..... A47B 91/00

[52] U.S. Cl. ..... 248/346.11

[58] Field of Search ..... 248/346.01, 346.11, 248/146; 215/394, 393; 220/330, 630; D7/624, 625; D8/374

[56] References Cited

U.S. PATENT DOCUMENTS

| | | | |
|---|---|---|---|
| 1,971,337 | 8/1934 | Collins | 248/346.11 |
| 2,151,024 | 3/1939 | Gilbert | 132/36.2 |
| 2,176,109 | 10/1939 | Ratay | 221/60 |
| 2,222,343 | 11/1940 | Wasserman | 154/44 |
| 2,688,858 | 9/1954 | Cosmetto | 65/53 |
| 3,257,092 | 6/1966 | Blundell | 248/346.11 |
| 3,268,198 | 8/1966 | Swett | 248/346.11 |
| 3,357,590 | 12/1967 | Safford | 215/394 X |
| 3,363,869 | 1/1968 | Blundell | 248/346.1 |
| 3,623,934 | 11/1971 | Madou | 161/5 F |
| 4,089,498 | 5/1978 | Woodruff | 248/346.1 |
| 4,584,223 | 6/1984 | Krapf | 428/58 |
| 4,760,987 | 8/1988 | Lan | 248/346.1 |
| 4,828,345 | 5/1989 | Kitamura et al. | 350/1.6 |
| 4,858,872 | 8/1989 | Witt | 248/346.1 |
| 5,273,182 | 12/1993 | Laybourne | 248/346.1 X |
| 5,938,162 | 8/1999 | Honjo | 248/346.11 |

*Primary Examiner*—Ramon O. Ramirez
*Assistant Examiner*—Gwendolyn Baxter
*Attorney, Agent, or Firm*—Madan, Mossman & Sriram, P.C.

[57] ABSTRACT

A coaster constructed for the purpose of sustaining the weight of glasses, bottles, cans and other receptacles containing drinks and other liquids and which is composed of mesh joined with an absorbent layer and held in place by a frame. The coaster permits air to circulate through the multiple cavities of the mesh to accomplish the evaporation of moisture and surface non-adherence and to allow any remaining residue to be easily absorbed by the absorbent bottom layer, which is extended in such a manner as to provide further ventilation by virtue of stand-off features or feet affixed on the base or bottom of the coaster.

18 Claims, 1 Drawing Sheet

CLING RESISTANT DRINK COASTER

FIELD OF THE INVENTION

The invention relates to drink coasters, and further relates, in one embodiment, to drink coasters that seek to minimize or to eliminate adhesive and damaging moisture through the presence of absorbent materials and/or supportive cavities facilitating air circulation.

BACKGROUND OF THE INVENTION

Throughout history, various nations, societies and civilizations in numerous epochs have endeavored to produce devices of protection and convenience for the sole purpose of preventing the accumulation of adherent moisture associated with the use of drinks and liquids contained in moisture-bearing vessels, utensils and containers which were at temperatures lower than the dew point of the environment. Indeed, even Greek mythology mentions the inconvenience of unabsorbed moisture encountered by the Hellenic deities as they consumed their various libations on the heights of Olympus. And today it is common to see inconvenienced bar patrons struggle with coasters which do not adequately dispose of adherent moisture and which cling to glasses, cans, bottles and any other containers bearing or producing condensation and, subsequently, leaving potentially damaging moisture on surfaces.

The most common coasters are characterized by a one-layer construction of absorbent material composed of cork, wood or paper fiber or cotton; and which, when overladen or saturated with moisture, no longer suffice to provide a damp-proof, protective device. To the contrary, such coasters ultimately permit an adhesive seal, which joins the coasters to the containers.

Subsequent improvements of the art in the modern era have witnessed numerous attempts to cope with the problem of attendant moisture coming into contact with and damaging finished surfaces.

An improvement of the coaster art occurred with U.S. Pat. No. 3,363,869 (Blundell). In this folding unit, a napkin or other absorbent material was placed into the interior, while a lattice top (once folded over the napkin or absorbent material) provided a degree of aeration to assist in the disposal of condensation. Although representing an advance in the art, the device still presented some obvious difficulties: (1) the inconvenience of the periodic disposal of a saturated napkin or other absorbent material; and (2) the presence of a retaining well, which would demand recurring emptying and/or attention to condensation on the exterior of the rim.

Prior to Blundell, U.S. Pat. No. 2,688,858 (Cosmetto) sought to combine the functions of absorbency and aeration in a circular coaster of low-cost plastic molding, including a top of relatively large interlocking and circular grills, under which lay a slot for removal and replacement of saturated absorbent blotters, surrounded by a plastic, circular supporting frame. It was assumed that the large circular grills would dispense with major amounts of condensation, while what remained of the moisture would be absorbed by the disposable blotters. Although the factor of aeration represented by the large circular grills was a positive development, the inconvenience of disposal of a saturated absorber was not, significantly, dealt with, and the close proximity of the blotter to supporting surfaces held great potential for damage to those surfaces. Also, the relatively large size of the supporting grills made it more likely that large amounts of moisture would be channeled into the replaceable absorbent material, which was positioned at the base of the coaster and directly on furniture and other supporting surfaces.

U.S. Pat. No. 4,858,872 (Witt) describes a coaster for supporting glasses and other containers which includes a tray which is mounted in spaced vertical relationship with respect to a base element in such a manner that an open air space is created therebetween. The tray is provided with a plurality of drain openings which communicate with an absorbent pad or wick material which is mounted beneath or suspended from the tray so as to receive condensation and other moisture passing through the drain openings. Nevertheless, the coaster of this patent is characterized by several disadvantages, to wit: (1) the expense and inconvenience of the possible necessity of replacing spoiled absorbent material and holding trays; (2) the coaster, as described in its various forms, could be expensive and laborious to produce and could not fulfill the needs of a mass market; (3) regular vigilance is demanded in order to prevent spillage from the attached tray and to determine if an absorbent pad is in need of replacement; (4) as disclosed in accompanying illustrative drawings of this invention, the "annular channels" do not seem of sufficient dimension to guarantee the direction of moisture in a downward path through the device and, ultimately, into the tray; and (5) the wick elements, if included in the embodiment which provides for direct contact with the condensation basin, risk becoming noxious conductors of resultant odors from deterioration byproducts or the possible accumulation of mildew or other mold.

It would be desirable if a cling resistant drink coaster could be devised which would overcome many of the disadvantages of prior coasters.

SUMMARY OF THE INVENTION

Accordingly, it is an object of the present invention to provide a drink coaster that is cling resistant and inexpensive to manufacture.

It is another object of the present invention to provide a cling resistant drink coaster that enables evaporation and wicking away of moisture condensed on a container placed on the coaster.

It is yet another object of the invention to provide a cling resistant drink coaster that does not require replacement of the absorbent material, and which may be made inexpensively enough to be disposable.

In carrying out these and other objects of the invention, there is provided, in one form, a cling resistant drink coaster having an absorbent bottom layer; and a top grating layer.

It will be appreciated that the drawings may not be necessarily to scale, and that certain features may be exaggerated in proportion to other feature for emphasis.

DETAILED DESCRIPTION OF THE INVENTION

The invention concerns inexpensive, light-weight coasters, which accomplish the goals of moisture drainage and evaporation and non-adherence to the drink container via the circulation of air and wicking away of moisture in a throwaway, disposable unit, which provides useful features without the inconveniences of larger and more expensive, prior coasters. This invention aims to provide protection of any supporting surface underlying the coaster and the elimination of inconvenience brought about by sticking of the coaster to any surface, such as a table, bar, desk, etc., as well as to the drink container itself To achieve this end, structural elements are used in conjunction with porous and absorbent substances and are combined to produce a coherent coaster unit of layered matter. In one non-limiting embodiment, the invention is composed of a rim and an inner core of absorbent material and may include a supportive, aerated top grating layer which can be of various materials.

Figure 1:
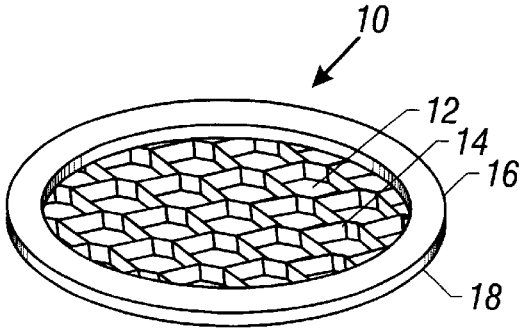
FIG. 1 is a three-quarters, perspective view of one embodiment of the cling resistant drink coaster of this invention in assembled form.
Figure 2:
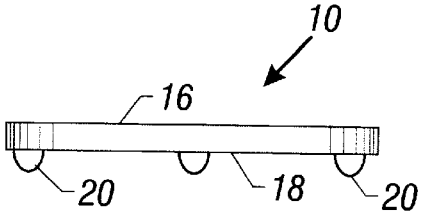
FIG. 2 is a side, elevation view of one embodiment of the cling resistant drink coaster of this invention illustrating the stand-off features thereof.

Referring more specifically to FIG. 1 there may be seen a cling resistant drink coaster generally referred to as 10 which comprises an absorbent bottom layer 12 and a top grating layer 14 with a top edge surface 15. Frame 16 is present to hold absorbent bottom layer 12 and a top grating layer 14 together. Frame 16 may have a bottom 18, and a plurality of stand-off features 20 or feet to keep the bottom 18 of coaster 10 off of the support surface, e.g. table, desk, etc. as shown in FIG. 2.

Figure 3:
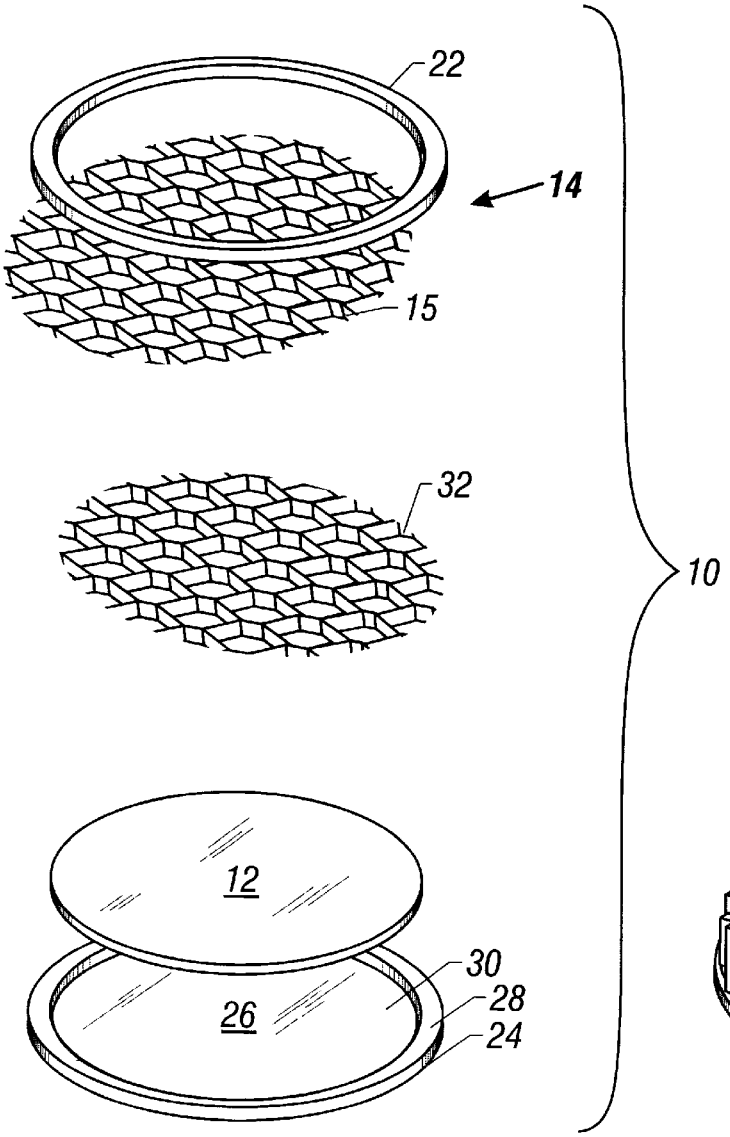
FIG. 3 is a three-quarters, perspective, exploded view of yet another embodiment of the cling resistant drink coaster of this invention showing the various parts thereof.

The elements of and arrangement thereof in another embodiment of the invention is shown in exploded view in FIG. 3. In this particular representative, but not limiting embodiment, frame 16 has two portions, a top portion, in the shape of a ring 22, and a bottom portion, which can be understood as a plate 24 with an interior floor 26 and a lip 28 to form a shallow cavity 30. Interior floor 26 is preferably, in one embodiment, contiguous or complete to help prevent moisture moving from absorbent layer 12 onto the support surface.

Absorbent bottom layer 12 is shaped and designed to fit within cavity 30 of plate 24. Top grating layer 14 is shaped and designed to be engaged by ring 22. Ring 22 mates with plate 24 to hold top grating layer 14 into contact with absorbent bottom layer 12 to form the finished cling resistant drink coaster 10, in one embodiment.

The particular embodiment of the cling resistant drink coaster 10 shown in FIG. 3 has an intermediate grating layer 32 between top grating layer 14 and absorbent bottom layer 12. Intermediate grating layer 32 may be different, but may be identical to top grating layer 14 except for its position intermediate to top grating layer 14 and absorbent bottom layer 12, and its orientation. That is, it is a preferred feature of the invention that any intermediate grating layer 32 is not aligned with any adjacent top grating layer 14. Although this non-alignment is not a necessary feature of the invention, it is preferred because it provides reinforced support for a drink container placed on coaster 10. Non-alignment of adjacent grating layers may be accomplished by rotation, or other movement so that the openings and solid structures, e.g. latticework, of the adjacent grating layers are not exactly adjacent and oriented alike.

As noted, the cling resistant drink coaster 10 does not stick to the bottom of containers having condensed moisture thereon, and protects the support surface from becoming damp. The inventive features which permit this to be accomplished include, but are not necessarily limited to:

1. Minimal surface contact of the top grating layer 14 with the bottom of the drink container. In a preferred embodiment the grating layers, whether top grating layer 14 or an intermediate grating layer 32, lie in a plane where there is at least one solid structure having therein a plurality of open areas therein. The open area should exceed the solid area; e.g. more area given to holes than to the lattice structure when viewed perpendicular or normal to the primary plane of the layers. The primary plane of all of the layers herein is defined as that through the center of gravity of the layer which parallels a flat support surface when the layer is flat on the support surface. Having more open area v. solid area permits air flow for evaporating the moisture. It is also preferred that any of the grating layers be a lattice of flat material having the edge of the flat material at an angle, even perpendicular or normal, to the plane of the grating layer, such as shown in FIGS. 1 and 3. Having multiple contact points encourages condensed moisture to pass from the container through the top grating layer 14 toward and onto the absorbent layer 12. The open nature of the grating layers also permits air to flow freely around them and the bottom of the container to permit evaporation to readily occur. This feature is contrasted with closed nature of the tray elements of U.S. Pat. No. 4,858,872 which are more closed, i.e. more closed area than open area (channels). In one sense, this feature may be understood to be "supportive cavities"; i.e. a mesh, grid, lattice or the like having more open space than solid surface.

2. Sufficient distance between the top surface 15 of top grating layer 14 and the absorbent bottom layer 12. In one non-limiting theory of the success of the invention, it may help to have some distance between the top surface 15 of top grating layer 14 and the absorbent bottom layer 12 to help prevent the accumulation of enough moisture at the contacting surfaces so that the surface tension of the condensed moisture is so great as to cause the coaster 10 to temporarily adhere to the bottom of the drinking container. Conventional fiberboard coasters found in restaurants, pubs, and the like, while absorbent, readily adhere to the bottom of a drink container due to the adhesive forces of the condensed water overcoming the pull of gravity on the lightweight fiberboard disk. Wicking water a distance from the surface on which it condenses to an absorbing medium further helps reduce this contact. Sufficient distance may be obtained by making single top grating layer 14 sufficiently thick or high, or by using multiple grating layers to achieve such thickness or height. While it is expected that the top grating layer 14 will be in physical contact with the absorbent bottom layer 12 and/or any intermediate grating layers 32 or mesh layer (s) to help channel moisture down to the absorbent bottom layer 12 for absorption thereon, this contact may not be necessary in some embodiments. This continuous physical contact from the top surface 15 of top grating layer 14 to absorbent bottom layer 12 is an improvement on such coasters as shown in U.S. Pat. No. 4,858,872 where there is an open air space that the water is required to drip or jump from.

Moving the water away from the condensing surface at a sufficient rate, by wicking or gravity or a combination thereof, at least a rate sufficient to prevent adhesion of the coaster 10 to the container, would be helped by sufficient distance between the top surface 15 of top grating layer 14 and absorbent bottom layer 12. While removing condensed moisture from the surfaces of the container faster than the water condenses would certainly accomplish the goals of the invention, it is not necessary to achieve the required level of water removal.

3. Weight. Certainly conventional sandstone coasters do not suffer from temporary adhesion to the bottom of a drinking container due to their weight. However, such coasters and others of sufficient weight so that gravity keeps them on the support surface (e.g. table) are generally not understood to be inexpensive enough to be disposable. Nevertheless, if the combined weight of the grating(s), absorbent layer and frame is sufficient, the weight of the cling resistant coaster 10 of this invention will contribute to its cling resistance.

Turning to the various elements of the cling resistant coaster 10 of the invention, absorbent bottom layer 12 may be of any suitably absorbent material including, but not necessarily limited to, paper, cellulose, cotton, absorbing plastic or other synthetic material, cork, cardboard, cloth, sponge, or other absorbing material to serve as a blotter or napkin, and may be identical to the disposable fiberboard coasters conventionally used.

Intermediate grating layer 32 may instead be less strong than top grating layer 14 in which case it may be called a mesh layer. In models of the cling resistant coaster 10 built by the inventor, multiple mesh layers are used which are identical in superficial appearance to intermediate grating layer 32 and top grating layer 14, but which are made of thinner material and thus would collapse more readily under the weight of a drinking container. However, such multiple mesh layers, non-aligned with any adjacent mesh layer or grating layer, may still provide the requisite distance between the top surface 15 of the top grating layer 14 and the absorbent bottom layer 12, discussed above. Mesh layers may be made of thinner material and thus be less expensive than the material used to make top grating layer 14, even though it will be understood that the mesh layer itself may have a manufactured or produced thickness, once formed, equal to that of top grating layer 14. Even if multiple mesh layers were initially aligned, due to their relative weak nature, they could and probably would be eventually crushed due to the weight of a full container placed over them which may and probably would place them out of alignment.

The only real necessary difference between top grating layer 14 and any mesh layer is that top grating layer 14 must be of sufficient structural strength to hold a drinking container upright consistently and repeatedly. The top grating layer 14 depicted in FIGS. 1 and 3 is of a kind of grating or mesh made from a single sheet of material that has been cut in rows of alternating slits and then pulled to open it into a mesh or grating appearance. Such meshes or gratings are commonly available and made of aluminum, plastic or other materials.

The materials of any grating layer(s) and mesh layer(s) may be identical or different, and may include, but are not necessarily limited to, metal, such as aluminum, stainless steel, etc.; wood; plastic; stone; cement; ceramic; glass; bamboo; fiberglass; bone; even absorbent materials of sufficient strength, e.g. paper, cellulose, cotton, of structurally stronger forms than anticipated for the absorbent bottom layer; and the like.

It is further not at all necessary that the apertures or openings in the grating layer(s) or mesh layers(s) be flattened hexagons as depicted in FIGS. 1 and 3. Any suitable regular or irregular, repeating or non-repeating apertures or openings may be used including, but not necessarily limited to, circles, squares, rectangles, triangles, pentagons, etc.

Frame 16 may be of any of the materials described above for the grating layer(s) and mesh layer(s), although in one preferred embodiment of the invention, the frame 16 should not be made of any absorbent materials. It is not expected that the person using the drinking glass or other container may use any particular care in placing the glass on the coaster 10, and it would be preferred that the frame 16 itself not be absorbent to avoid problems possessed by conventional coasters.

It is not necessary that the cling resistant coaster 10 of this invention have a circular shape as depicted in FIGS. 1 and 3, although it is expected that this may be the most common commercial shape since most drinking containers have a circular footprint. Most coasters on the market are circular as are most shown in prior patents. Other shapes possible include, but are not necessarily limited to circular, oval, square, rectangular, triangular, hexagonal, pentagonal, irregular, and the like.

Figure 4:
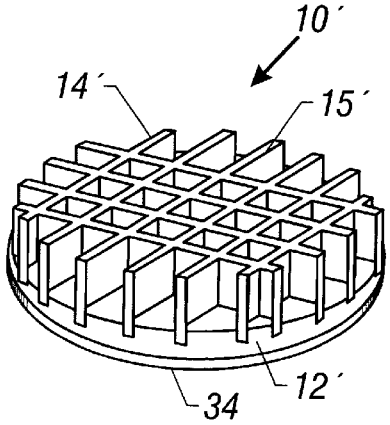
FIG. 4 is a three-quarters, perspective view of yet another embodiment of the cling resistant drink coaster of this invention which does not require a frame.

It is entirely possible that the cling resistant coaster 10 of this invention consists of only the top grating layer 14' and absorbent bottom layer 12', that is, in the absence of a frame or a separate element holding them together, as shown in FIG. 4; where corresponding reference numerals refer to corresponding features. For example, top grating layer 14' could be embedded into absorbent bottom layer 12' and have sufficient thickness, low surface contact to the bottom of a drinking container and be sufficiently open to accomplish the purposes of this invention. Absorbent bottom layer 12' could be of graduated absorbency, e.g. of greater absorbency on the top side with the grating layer 14' and of less absorbency on the bottom thereof. Such a characteristic would help prevent absorbed water from contacting the support surface.

Alternatively, or in addition to the above-described features, absorbent bottom layer 12' may have an optional impermeable layer or coating 34 on the bottom or lower portion of layer 12'. Impermeable layer or coating 34 may be plastic, wax, or any other suitable, non-absorbent material to help prevent moisture in absorbent bottom layer 12' from contacting the support surface. Impermeable layer or coating 34 may be applied in any conventional way including, but not necessarily limited to, applying the coating 34 in molten state and letting it dry or cure, gluing it on, molding it on, etc. or by any suitable process yet to be developed.

In another embodiment, absorbent bottom layer 12 could be surrounded by a wire mesh "cage" which serves as top grating layer 14 whether the coaster 10 was right side up or upside down. In such an embodiment, there would actually be no "upside" or "downside", but the coaster 10 would be symmetrical and identical through its central plane. Such an embodiment would have the advantage of the conventional thin fiberboard coasters in that a server would not have to be careful to make sure the coaster 10 was oriented with the "upside" up before placing a drink container thereon. The "bottom" of the "cage" would serve as a stand-off feature 20 to hold absorbent bottom layer 12 off of the support surface to protect it.

Still another embodiment of the invention would have a top grating layer 14 and any intermediate layers whether grating or mesh layers, if present, to be sufficiently open so that any indicia printed on the absorbent layer 12 would be visible and legible. Indeed, the grating layer(s) and/or mesh layers(s) could be made of a transparent material, such as plastic or glass, to further permit any indicia on the absorbent layer 12 to be visible.

The cling resistant coaster 10 of the present invention may be produced in disposable or permanent forms, depending only upon the economics involved. Of course, disposable coasters 10 to compete with conventional fiber-board disks would need to be made of relatively inexpensive materials.

A coaster 10 made of a paperboard absorbent bottom layer 12 having a plastic top grating layer 14 embedded therein would be one non-limiting example of an inexpensive, disposable coaster. A coaster 10 having a sandstone absorbent bottom layer 12 with one or more transparent plastic grating layers 14 held within a frame 16 that would permit the transparent plastic grating layers 14 to rotate with respect to each other to cause interesting optical effects on any indicia printed on the absorbent bottom layer 12 would certainly be more expensive and be considered a non-disposable coaster 10.

Further, the cling resistant coaster 10 of the present invention may be assembled in its various embodiments using known techniques including, but not necessarily limited to, adhesives, force fit designs, fasteners (e.g. rivets, screws, nails, bolts and nuts, etc.), conventionally known or yet to be developed.

The stand-off features or "feet" 20 on the bottom 18 of frame 16 need not be as depicted in FIG. 2, and may be any suitable conventional or not conventional feature that accomplishes this purpose. It may not even be necessary that there be a plurality of stand-off features 20, although it is anticipated that at least three relatively small stand-off features 20 will permit air circulation beneath the bottom of the coaster 10 in the event moisture collects on the bottom thereof because of careless placement of the drink container on the coaster 10 by the user.

Many modifications may be made in the cling resistant drink coaster of this invention without departing from the spirit and scope thereof which are defined only by the appended claims. For example, it may be discovered that a particular pattern of openings and solid structure on the grating layer(s) and/or the mesh layer(s), or a particular size and shape of the grating layer(s) and/or the mesh layer(s) may be particularly advantageous. Alternatively, the exterior shape or size of the coaster and/or frame, if present, may be found to have a particular shape or dimension that is preferred over other shapes. For example, it is known to make coasters which nest or stack into one another for ease of storage, and the coasters of this invention could be adapted and designed to be stacked or nested. Further, in the case of non-disposable coasters, it may be desirable to make the absorbent bottom layer 12 to be removable and disposable in the event it becomes too soiled or in other used condition that makes it desirable to be removed while retaining the top grating layer 14 and/or the frame 16. All of these possibilities, and others, would be within the scope of the invention.

I claim:

1. A cling resistant drink coaster comprising:

an absorbent bottom layer;

a top grating layer; and at least one intermediate grating layer present between the top grating layer and the absorbent bottom layer where there is physical contact between adjacent layers.

2. The cling resistant drink coaster of claim 1 where the top grating layer has a solid area and an open area where the open area exceeds the solid area.

3. The cling resistant drink coaster of claim 1 where the top grating layer is in physical contact with the absorbent bottom layer; and the top grating layer has sufficient height to wick condensed moisture from a container placed thereon to the absorbent bottom layer to inhibit adherence of the coaster on the container.

4. The cling resistant drink coaster of claim 1 where the intermediate grating layer and the top grating layer are not aligned.

5. The cling resistant drink coaster of claim 1 further comprising more than one intermediate grating layer, and where any two adjacent grating layers are not aligned with one another.

6. The cling resistant drink coaster of claim 1 further comprising a frame holding the layers together.

7. The cling resistant drink coaster of claim 1 where the coaster further comprises a bottom with a plurality of stand-off features thereon.

8. The cling resistant drink coaster of claim 1 where the top grating layer has a primary plane and is made of a flat material having an edge where the edge is at an angle to the primary plane of the top grating layer.

9. The cling resistant drink coaster of claim 1 where the absorbent bottom layer has an impermeable layer on at least a part of a lower portion of the absorbent bottom layer.

10. A cling resistant drink coaster comprising:

an absorbent bottom layer;

at least one top grating layer; and at least two mesh layers between the absorbent bottom layer and the top grating layer where there is physical contact between adjacent layers.

11. The cling resistant drink coaster of claim 10 where any mesh layer is not aligned with an adjacent grating layer or an adjacent mesh layer.

12. The cling resistant drink coaster of claim 10 further comprising a third mesh layer between the absorbent bottom layer and the top grating layer, where any mesh layer is not aligned with an adjacent grating layer.

13. The cling resistant drink coaster of claim 10 where the top grating layer has a solid area and an open area where the open area exceeds the solid area.

14. The cling resistant drink coaster of claim 10 further comprising a frame holding the layers together.

15. The cling resistant drink coaster of claim 14 where the frame further comprises a bottom with a plurality of stand-off features thereon.

16. The cling resistant drink coaster of claim 10 where the top grating layer has a primary plane and is made of a flat material having an edge where the edge is at an angle to the primary plane of the top grating layer.

17. The cling resistant drink coaster of claim 10 where the absorbent bottom layer has an impermeable layer on at least a part of a lower portion of the absorbent bottom layer.

18. A cling resistant drink coaster comprising an absorbent bottom layer;

at least one top grating layer; and at least one first mesh layer between the absorbent bottom layer and the top grating layer where the top grating layer is in physical contact with the first mesh layer;

the first mesh layer is in physical contact with the absorbent bottom layer; and the top grating layer and the first mesh layer together have sufficient height to wick condensed moisture from a container placed on the top grating layer to the absorbent bottom layer to prevent condensed moisture from adhering the coaster to the container.

* * * * *